US007918292B2

(12) United States Patent
Felderhoff et al.

(10) Patent No.: US 7,918,292 B2
(45) Date of Patent: Apr. 5, 2011

(54) EARTH-BORING TOOLS HAVING FEATURES FOR AFFECTING CUTTINGS FLOW

(75) Inventors: Floyd C. Felderhoff, Montgomery, TX (US); Rudolf Carl Pessier, Galveston, TX (US); Yolanda V. Morse, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 193 days.

(21) Appl. No.: 12/169,962

(22) Filed: Jul. 9, 2008

(65) Prior Publication Data

US 2010/0006343 A1 Jan. 14, 2010

(51) Int. Cl.
*E21B 10/18* (2006.01)

(52) U.S. Cl. ..... 175/339; 175/393

(58) Field of Classification Search ..... 175/339, 175/340, 393

See application file for complete search history.

(56) References Cited

U.S. PATENT DOCUMENTS

| | | | | |
|---|---|---|---|---|
| 4,091,884 | A | 5/1978 | Thomas | |
| 5,547,033 | A | 8/1996 | Campos, Jr. | |
| 5,553,681 | A | 9/1996 | Huffstutler et al. | |
| 6,450,270 | B1 * | 9/2002 | Saxton | 175/339 |
| 7,182,162 | B2 | 2/2007 | Beuershausen et al. | |
| 2010/0089656 | A1 * | 4/2010 | Ho et al. | 175/340 |

OTHER PUBLICATIONS

International Search Report for International Application No. PCT/US2009/049680 mailed Feb. 18, 2010, 3 pages.

Written Opinion for International Application No. PCT/US2009/049680 mailed Feb. 18, 2010, 5 pages.

* cited by examiner

*Primary Examiner* — William P Neuder

(74) *Attorney, Agent, or Firm* — TraskBritt

(57) ABSTRACT

An earth-boring bit has a bit body having a plurality of bit legs extending longitudinally therefrom, each bit leg comprising one or more groove regions formed along a laterally outer surface thereof. Each groove region comprises a fluid course for drilling fluid and cuttings to pass across the outer surface. A ridge may be disposed adjacent a lower edge of one or more of the groove regions. Each groove region may also be positioned at differing heights on the bit legs. Methods of forming earth-boring bits are also disclosed.

22 Claims, 6 Drawing Sheets

EARTH-BORING TOOLS HAVING FEATURES FOR AFFECTING CUTTINGS FLOW

TECHNICAL FIELD

Embodiments of the invention relate generally to earth-boring tools, such as rotary drill bits, and particularly to earth-boring tools having features for affecting the flow of drilling fluid and formation cuttings past the tools during drilling, and to methods of forming such tools.

BACKGROUND

In drilling bore holes in subterranean earth formations by the rotary method, drill bits fitted with one or more cutters are conventionally employed. For example, rolling cutter or "rock bits" that include three rolling cutters or cones may be employed. The drill bit is secured to the lower end of a drill string, which may be rotated from the surface using a rotary table or top drive, from within the bore hole using a down-hole motor or turbine, or using a combination of drive systems. The rolling cutters mounted on the drill bit roll and slide on and across the exposed surface of the formation at the bottom of the bore hole as the bit is rotated, crushing and scraping away the formation material. Cutting elements in the form of inserts or integrally formed teeth are provided on the exterior surface of the rolling cutters and the weight-on-bit (WOB) applied thereto forces the cutting elements on the rolling cutters to penetrate and gouge the formation.

During drilling, drilling fluid is pumped down the bore hole through the drill string to the drill bit. The drilling fluid passes through an internal longitudinal bore (or plenum) within the drill bit and through other fluid conduits or passageways within the drill bit to nozzles that direct the drilling fluid out from the drill bit at relatively high velocity. The nozzles may be directed toward the rolling cutters and cutting elements thereon to clean formation cuttings and detritus from the cutters and prevent "balling" of the drill bit. The nozzles also may be directed past the rolling cutters and toward the bottom of the bore hole to flush cuttings and detritus off from the bottom of the bore hole and up the annulus between the drill string and the bore hole wall.

In inclined and horizontal bore holes, the cuttings that are flushed from the bottom of the well bore may gravitate to the lower side of the annulus where they accumulate in a layer or bed of mud and cuttings. The thickness of this cuttings bed may vary depending on the inclination of the bore hole, the rotational speed of the drill bit and the ability of the nozzles and drilling fluid to flush the cuttings. The exterior surfaces of the drill bit must rotate through this bed of abrasive cuttings which can cause the surfaces of the drill bit to wear, and may eventually lead to failure of the drill bit. In addition, the outer surface of the drill bit (e.g., the legs of a roller cone drill bit) form a large, smooth bearing surface which, in an inclined bore hole cause the drill bit to ride up or sit on the cuttings bed. As the bit rides up on the cuttings bed, the entire bit can become wedged between the cuttings bed and the opposing wall of the bore hole, resulting in increased torque and drag against the drill bit surfaces. This increase in torque and drag reduces the power delivered to the drill bit and can, in extreme cases, cause the drill bit to become stuck in the bore hole. Furthermore, formation cuttings which are preferentially extruded through the narrow, open space between the rolling cutters and the bit legs that support them can damage the seals that are positioned between the rolling cutters and the bearing shafts that extend from the bit legs and on which the rolling cutters are mounted.

It is known in the art to apply a layer of hardfacing over portions of the exterior surfaces of the drill bit to protect the bit against abrasive wear. As used herein, the term "hardfacing" means any material or mass of material that is applied to a surface of a separately formed body and that is relatively more resistant to wear (abrasive wear and/or erosive wear) relative to the material of the separately formed body at the surface. Conventional hardfacing includes hard particles, such as sintered, cast, or macrocrystalline tungsten carbide, dispersed in a metal or metal alloy matrix material. Such hardfacing materials are conventionally applied to the surfaces of a drill bit using a flame-spray process or a welding process.

Various attempts have been made to improve the flow of formation cuttings upward in the bore hole and to reduce the accumulation of formation cuttings between the rolling cutters and the bit legs. For example, U.S. Pat. No. 7,182,162 to Beuershausen et al., the disclosure of which patent is incorporated herein in its entirety by this reference, discloses drill bits that are configured to reduce the damaging effects of formation cuttings. However, as the lifespan of rolling cutters and drill bits employing rolling cutters continues to grow, the accumulation of formation cuttings over time can eventually damage the bearing seals between the rolling cutters and the bearing shafts on which they are mounted.

BRIEF SUMMARY

Various embodiments of the present invention are directed toward earth-boring bits comprising a bit body, a rotatably mounted cutter, and at least one groove region. The bit body may comprise a plurality of head sections joined together about a longitudinal axis. The at least one groove region may be formed in or on a laterally outer surface of at least one of the head sections, which may also be characterized as a radially outer surface. The at least one groove region may comprise an upper edge and a lower edge extending in a generally oblique orientation, which may also be characterized as a generally helical orientation across the at least one head section from a rotationally leading side thereof to a trailing side thereof. The at least one groove region may be configured to allow the flow of cuttings underneath the legs of the drill bit and divert the cuttings axially upward and across the at least one head section when the bit is rotated to drill an earth formation in an inclined bore hole.

Additional embodiments of the present invention are directed to methods of forming earth-boring bits. The methods comprise assembling a plurality of head sections about a longitudinal axis to form a bit body. Each head section of the plurality of head sections may comprise a cutter bearing shaft depending therefrom and a cutter may be rotatably mounted to the cutter bearing shaft. At least one groove may be formed on a laterally outer surface of at least one of the plurality of head sections and, more specifically, on a laterally outer surface of a leg portion thereof. The at least one groove may extend from a rotationally leading side to a rotationally trailing side of the at least one head section and may comprise an upper sidewall and a lower sidewall.

DETAILED DESCRIPTION

The illustrations presented herein are, in some instances, not actual views of any particular drill bit or portion of a drill bit, but are merely idealized representations which are employed to describe the present invention. Additionally, elements common between figures may retain the same numerical designation.

Figure 1:
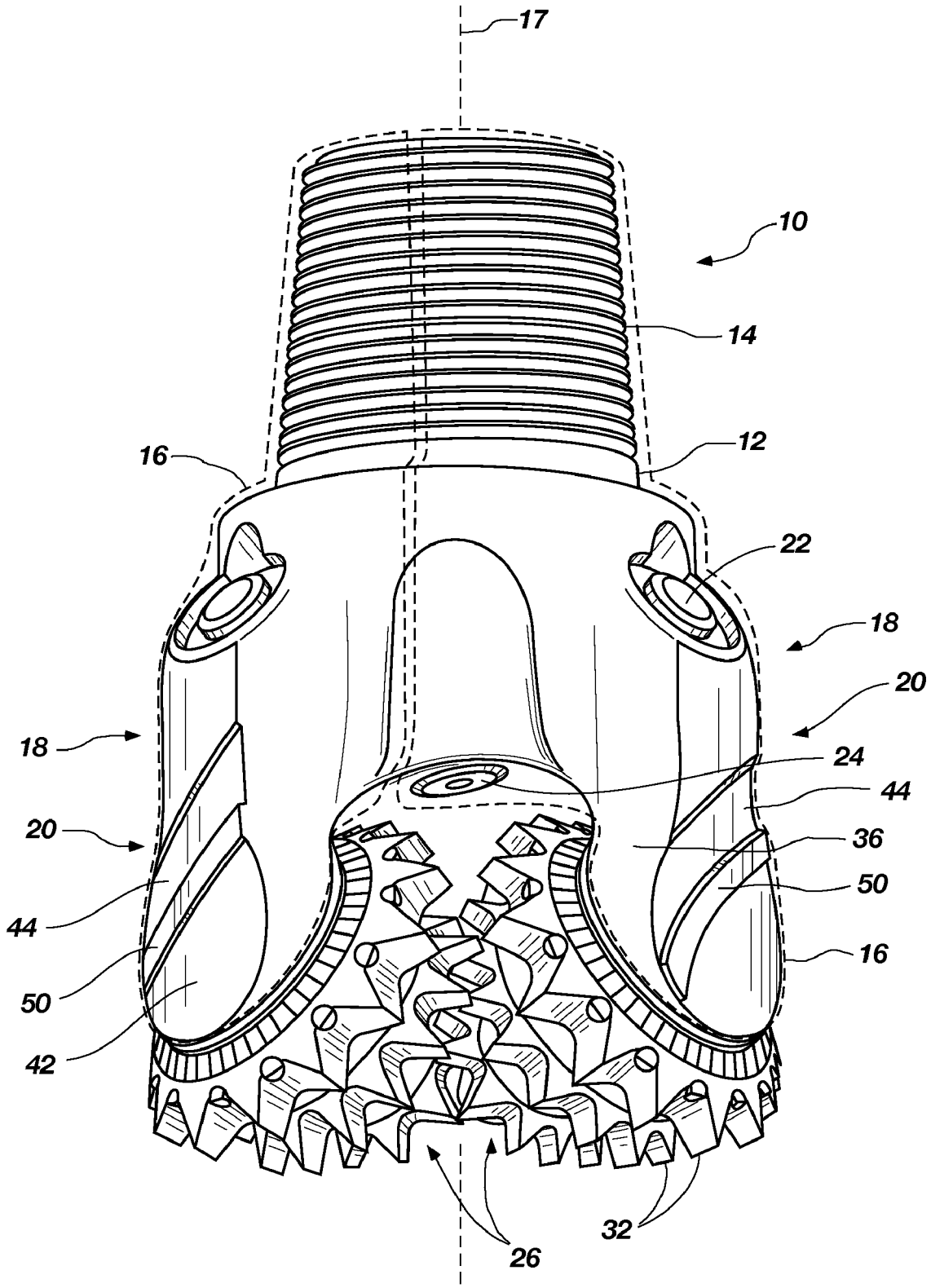
FIG. 1 is an elevation view of an embodiment of an earth-boring bit of the present invention.

In some embodiments, the present invention includes earth-boring bits comprising one or more head sections having one or more grooves therein for directing formation cuttings over an outer surface thereof along a selected, predefined path. FIG. 1 is an elevation view of an embodiment of an earth-boring bit 10 of the present invention. Earth-boring bit 10 includes a bit body 12 having threads 14 at its upper longitudinal end for connection to a drill string (not shown). The bit body 12 may comprise a plurality (e.g., three) of head sections 16 (which are separated by the dotted lines in FIG. 1) that are welded together concentrically about a longitudinal axis 17 during fabrication of the earth-boring bit 10, threads 14 then being machined in the conical upper shank region of the bit body 12. Two of the head sections 16 are visible from the perspective shown in FIG. 1, and for the purpose of convenience while describing each head section 16, only a single head section 16 is shown in FIGS. 2 through 5.

Each head section 16 comprises a head section body or upper section 18 nearest threads 14 (which are cut after assembly of the three head sections 16) and a bit leg 20 depending therefrom. Each upper section 18 of earth-boring bit 10 may be provided with a lubricant compensator 22. At least one nozzle 24 may be provided in bit body 12 for directing pressurized drilling fluid from within the drill string to flush cuttings and cool earth-boring bit 10 during drilling operation. A cutter or cone 26 is rotatably secured to a bearing shaft 40 (FIG. 5) of each respective bit leg 20 of bit body 12. By way of a non-limiting example, bit 10 has three cones 26, one of the three cones 26 being obscured from view in FIG. 1. Each cone 26 has rows of cutting elements 32. Cutting elements 32 may comprise teeth machined in the exterior of the cone body. Alternatively, the cutting elements 32 may comprise tungsten carbide inserts pressed into holes drilled in the surface of the cone body. Additionally, as shown in FIG. 1, a groove region 44 and a ridge region 50 may extend across an outer surface 42 of each bit leg 20, as discussed in further detail below.

Figure 2:
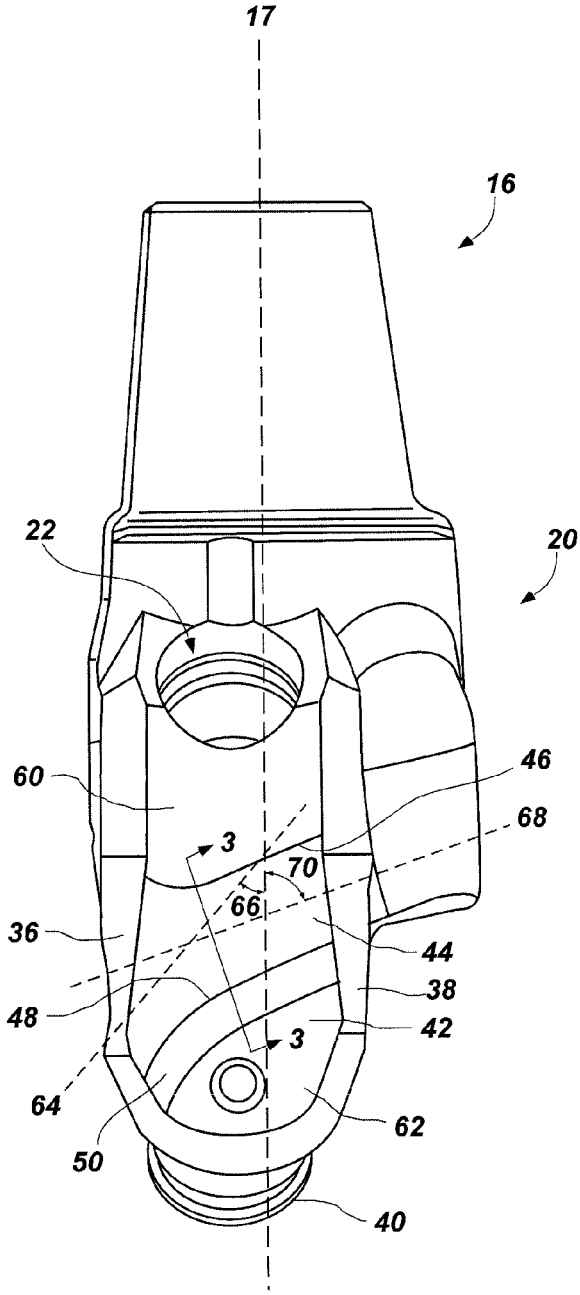
FIG. 2 is an elevation view of an embodiment of a head section of the invention.

FIG. 2 is an elevation view of an embodiment of a head section 16 of the present invention. Each bit leg 20 includes a rotationally leading side 36 and a rotationally trailing side 38. Leading side 36 is the side that generally first encounters the subterranean material in the bore hole being drilled due to the direction of rotation of the bit 10. Each bit leg 20 has an outer surface 42, and the outer surfaces 42 of the bit legs 20 of the bit 10 collectively define at least part of a circumferential outer surface of the bit 10 when all of the head sections 16 are assembled together to form the earth-boring bit 10. The outer surfaces 42 of each bit leg 20 may be machined to a relatively smooth finish, and may be sized and configured such that they do not extend radially outward beyond the radially outward-most point on each of the cones 26.

Figure 3A:
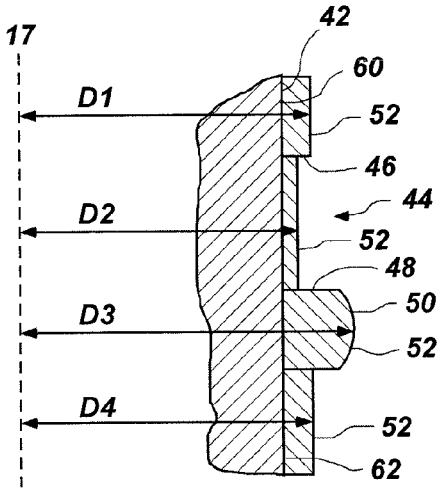
FIG. 3A is a partial cross-sectional view taken along line 3-3 of the head section shown in FIG. 2.

As shown in FIG. 2, the outer surface 42 of each bit leg 20 may comprise several different areas or regions. For example, the outer surface 42 may comprise a first shirttail region 62, a second ridge region 50, a third groove region 44, and a fourth upper region 60. FIG. 3A is a partial cross-sectional view taken along line 3-3 of the head section 16 shown in FIG. 2. As shown in FIG. 3A, the shirttail region 62, ridge region 50, the groove region 44, and the upper region 60 may be located at differing average radial distances from the longitudinal axis 17 of the bit 10. For example, the upper region 60 may be located at an average radial distance D1 from the longitudinal axis 17 of the bit 10, the groove region 44 may be located at an average radial distance D2 from the longitudinal axis 17 of the bit 10, the ridge region 50 may be located at an average radial distance D3 from the longitudinal axis 17 of the bit 10, and the shirttail region 62 may be located at an average radial distance D4 from the longitudinal axis 17 of the bit 10. In some embodiments, the average radial distance D2 may be less than each of the average radial distances D1, D3, and D4 such that the groove region 44 is or comprises a groove extending along the outer surface 42 of the bit leg 20, and the average radial distance D3 may be greater than each of the average radial distances D1, D2, and D4, such that the ridge region 50 is or comprises a ridge extending along the outer surface 42 of the bit leg 20 adjacent to and longitudinally below the groove region 44.

As shown in FIG. 3A, in some embodiments, the outer surface 42 of the bit leg 20 may be generally smooth and continuous, and differing thicknesses of hardfacing 52 may be applied to the outer surface 42 of the bit leg 20 in upper region 60, groove region 44, ridge region 50 and shirttail region 62 so as to define the differing average radial distances D1, D2, D3, and D4. By way of example and not limitation, the groove region 44 may comprise a first region of hardfacing material, the upper region 60 may comprise a second region of hardfacing material, the shirttail region 62 may comprise a third region of hardfacing, and the ridge region 50 may comprise a fourth region of hardfacing. Each region may comprise the average radial distance as described above.

Figure 3B:
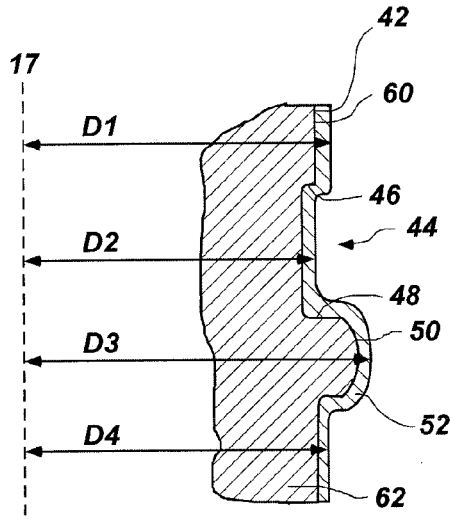
FIG. 3B is a partial cross-sectional view like that of FIG. 3A illustrating an additional embodiment of a head section of the invention.

As shown in FIG. 3B, in additional embodiments, the outer surface 42 of the bit leg 20 may be shaped and configured (e.g., machined) to form the shirttail region 62, ridge region 50, groove region 44, and upper region 60, and a layer of hardfacing 52 having substantially uniform thickness may be applied to the outer surface 42 of the bit leg 20 so as to define the differing average radial distances D1, D2, D3, and D4. For example, groove region 44 may comprise a depression or channel formed into the outer surface 42. The one or more groove regions 44 and/or ridge regions 50 may be formed into the outer surface 42 of the bit leg 20 by conventional methods as are known in the art. By way of example and not limitation, the outer surface 42 may be machined to form groove region 44 and/or ridge region 50. For example, the outer surface 42 may be ground, milled, or otherwise machined to form the upper region 60, groove region 44, ridge region 50, and shirttail region 62. Another non-limiting example includes forming the groove region 44 and/or ridge region 50 by forging or casting the head section 16 in a mold to define the features of the groove region 44, ridge region 50, upper region 60, and shirttail region 62.

In embodiments in which the groove region 44 is formed into the outer surface 42, the outer surface 42, including the groove region 44, may be covered by hardfacing 52. If the ridge region 50 is formed into the outer surface 42, the ridge region 50 may also be covered by the hardfacing 52. In other embodiments, an additional layer of abrasive material may be disposed to form the ridge region 50.

Referring again to FIG. 2, the groove region 44 and the ridge region 50 may divert formation cuttings over and past the bit leg 20 during drilling in a manner that reduces torque and drag as well as wear to the earth-boring bit 10. In other words, a lower edge 48 that is formed at the intersection between the groove region 44 and the ridge region 50 provides a wall which may aid in diverting drilling fluid and/or cuttings upward and away from the cutters. The groove region 44 and the ridge region 50 may extend from the leading side 36 in a generally helical direction to the trailing side 38 of the bit leg 20. In other words, the groove region 44 and the ridge region 50 may extend from the leading side 36 in a direction that is oriented at an angle to both a longitudinal plane (not shown) comprising the longitudinal axis 17 of the bit 10 and a transverse plane (not shown) oriented perpendicular to the longitudinal axis 17 of the bit 10. The groove region 44 may be defined between an upper edge 46 and a lower edge 48.

In some embodiments, the groove region 44 and the ridge region 50 each may begin at the front edge or rotationally leading side 36 with the lower edge 48 beginning in or proximate the shirttail 62. At the leading side 36, the groove region 44 may be configured so that there is little or no lip (FIG. 5), thereby allowing cuttings to freely flow into the groove region 44.

As shown in FIG. 2, on the rotationally leading side 36 of the bit leg 20, the groove region 44 and the ridge region 50 may extend toward the trailing side 38 in a general direction parallel to a plane 64 oriented at a first acute angle 66 relative to the longitudinal axis 17. By way of example and not limitation, the first acute angle 66 may be between about 10° and about 45°. As the groove region 44 and the ridge region 50 progress from the leading side 36 toward the trailing side 38, the upward angle of the groove region 44 and the ridge region 50 may gradually curve to become more shallow. On the rotationally trailing side 38 of the bit leg 20, the groove region 44 and the ridge region 50 may extend toward the trailing side 38 in an average direction parallel to a plane 68 oriented at a second acute angle 70 with the longitudinal axis 17 that is greater than the first acute angle 66. By way of example and not limitation, the second acute angle 70 may be between about 20° and about 80°.

In additional embodiments of the invention, the bit legs 20 may not include both a groove region 44 and a ridge region 50. For example, the bit legs 20 may include only a groove region 44 and not a ridge region 50, or the bit legs 20 may include only a ridge region 50 and not a groove region 44.

In some embodiments, substantially all of the outer surface 42 of the bit legs 20 may be covered with hardfacing 52. By way of example and not limitation, hardfacing 52 may be disposed over substantially the entire upper portion 60, and may extend upward from the upper edge 46 to proximate the lubricant compensator 22. Hardfacing 52 also may be disposed over the groove region 44, the ridge region 50, and substantially over the remaining shirttail region 62 (including over and around any ball bearing plug).

Figure 4:
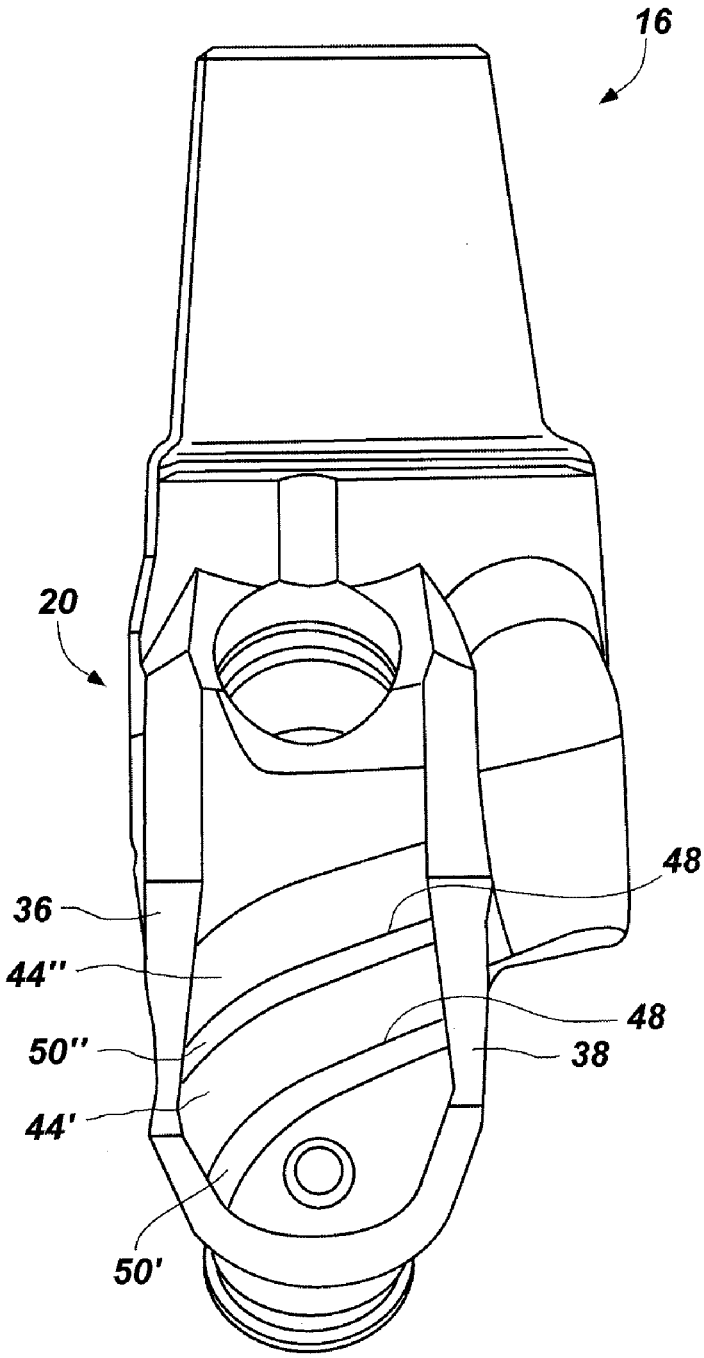
FIG. 4 is an elevation view of yet another embodiment of a head section of the present invention that includes more than one groove region.

Referring to FIG. 4, in yet further embodiments, the bit legs 20 may comprise two or more groove regions 44 and/or ridge regions 50. In such embodiments, a ridge region 50 may extend along and below each groove region 44. In other words, the lower edge 48 of each groove region 44 may be at least partially defined by a ridge region 50. For example, a ridge region 50' may extend along and below a groove region 44', and a ridge region 50" may extend along and below a groove region 44". The groove regions 44', 44" may extend from the leading side 36 to the trailing side 38 in a manner similar to that described above with reference to an embodiment having a single groove region 44 and a single ridge region 50, such as that illustrated in FIG. 2. In additional embodiments, the bit legs 20 may comprise more than two groove regions 44 and/or ridge regions 50. Furthermore, the bit legs 20 may have an equal number of ridge regions 50 and groove regions 44, or the bit legs 20 may have a different number of ridge regions 50 than groove regions 44.

Figure 5:
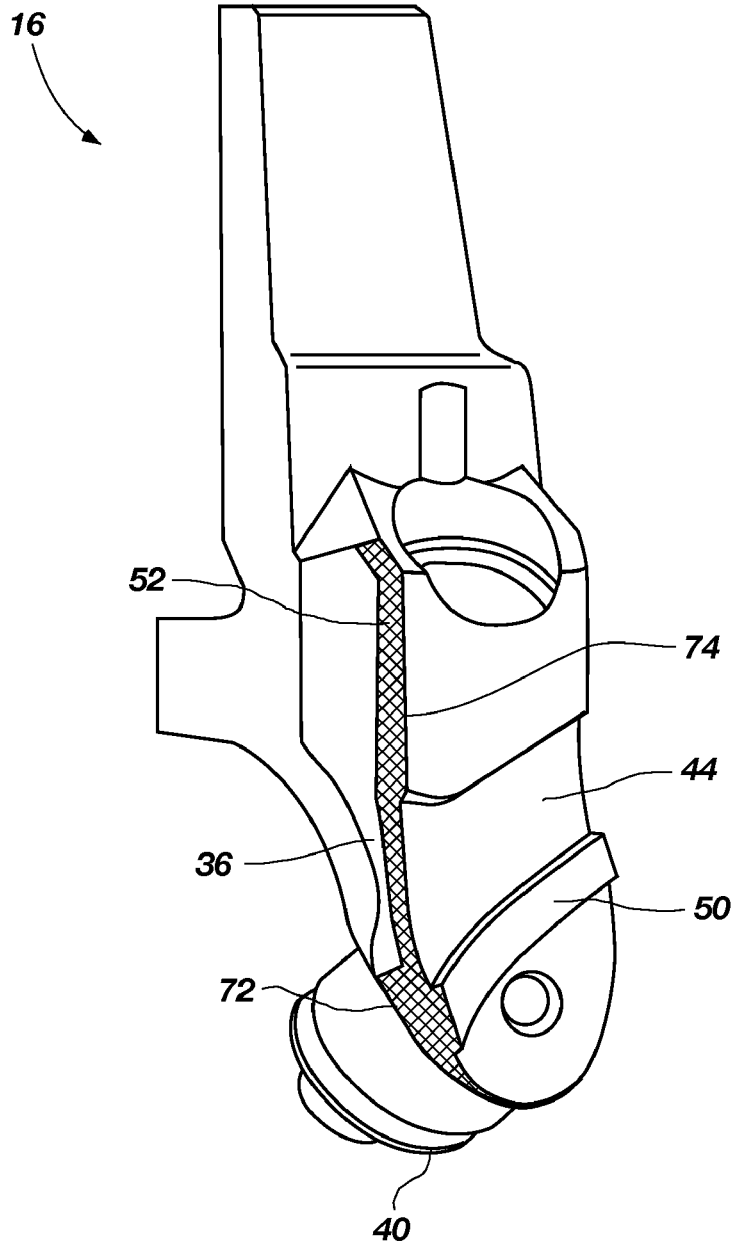
FIG. 5 is an elevation view depicting a leading side of a head section according to one embodiment.

FIG. 5 is an elevation view depicting the rotationally leading side 36 of a head section 16. As shown therein, a portion of the leading side 36 may include a layer or a bead of hardfacing 52. The hardfacing 52 may be disposed over a lower portion 72 of the leading side 36 as well as along an outer edge 74 of leading side 36 to prevent excessive wear along the leading side 36. The hardfacing 52 disposed over the lower portion 72 and along the outer edge 74 of the leading side 36 may be configured so that there is little or no lip at the entrance to the groove region 44 to allow cuttings to enter into the groove region 44 without obstruction.

In embodiments comprising more than one groove region 44 and/or more than one ridge region 50, the groove regions 44 and/or ridge regions 50 may be defined using differing thicknesses of hardfacing 52 applied to the outer surface 42, as previously described with reference to FIG. 3A, or the groove regions 44 and/or ridge regions 50 may be defined by machining the outer surface 42 of the bit legs 20 and providing a substantially uniform layer of hardfacing 52 material over the outer surface 42 of the bit legs 20.

By way of example and not limitation, the hardfacing 52 may be disposed on the outer surface 42 of the bit legs 20 by conventional means including flame spray processes and welding processes.

In operation, the earth-boring bit 10 is rotated on the end of a drill string and cones 26 are placed in contact with subterranean features in a bore hole. As pieces of the subterranean formation are cut from the bottom surface of the bore hole, those cuttings are mixed with the drilling fluid and caused to flow through groove region 44 along the outer surface 42, which may reduce accumulation of cuttings between the cones 26 and the bit leg 20.

Figure 6:
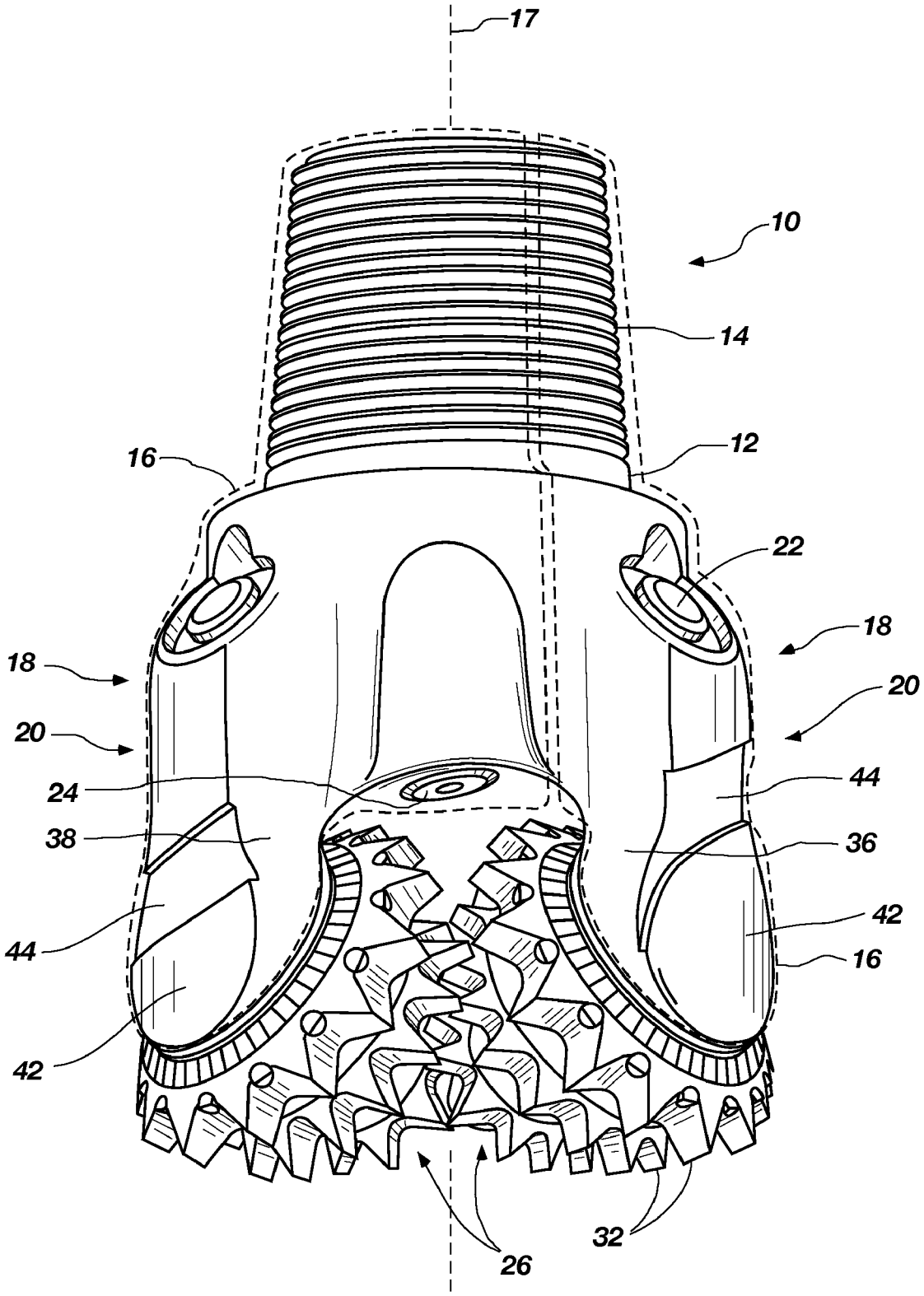
FIG. 6 illustrates an elevation view of an embodiment of an earth-boring bit in which at least two of the head sections include a bit leg comprising at least one groove region at different heights than the groove region on the other bit leg.

FIG. 6 illustrates an elevation view of an embodiment of an earth-boring bit 10 in which at least two of the head sections 16 include a bit leg 20 comprising at least one groove region 44 extending across the outer surface 42 thereof. The at least one groove region 44 on one bit leg 20 may be positioned at a height 76 (FIGS. 7A-7C) differing from the height 76 of the at least one groove region 44 on at least one other bit leg 20. The height 76 is generally shown as the height of a generally central flow axis 78 from the lower portion of the shirttail region 62. Although the head sections 16 in this embodiment may be configured similar to the head sections 16 described above with relation to FIGS. 2-4, including a groove region 44 as well as a ridge region 50, this embodiment is not so limited. Indeed, head sections 16 in this embodiment may also comprise a groove region 44 which does not include a ridge region 50 as well as any other configurations known to those of ordinary skill in the art.

Figure 7C:
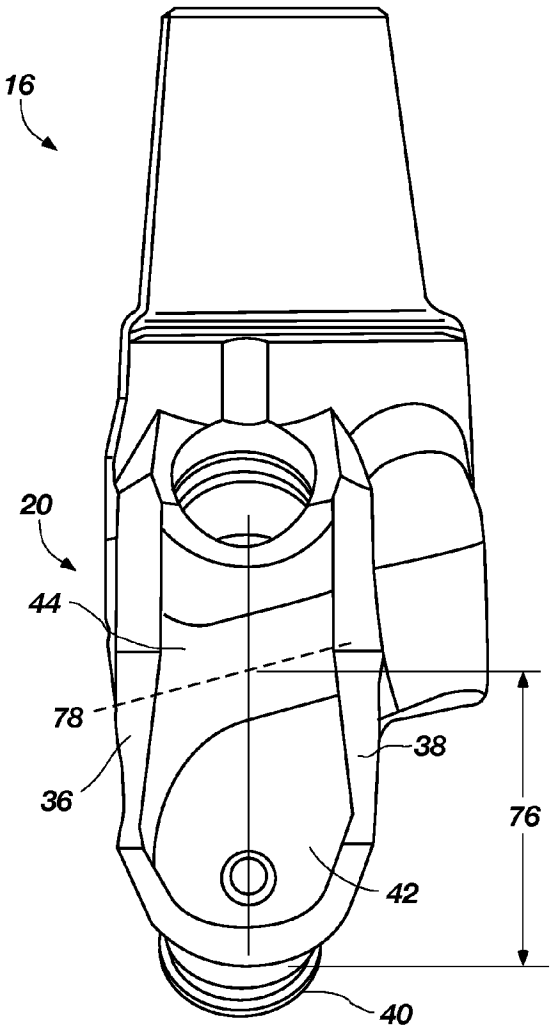
FIGS. 7A-7C illustrate an elevation view of individual head sections which may be assembled to comprise a bit body including three head sections similar to the bit body shown in FIG. 6.
Figure 7B:
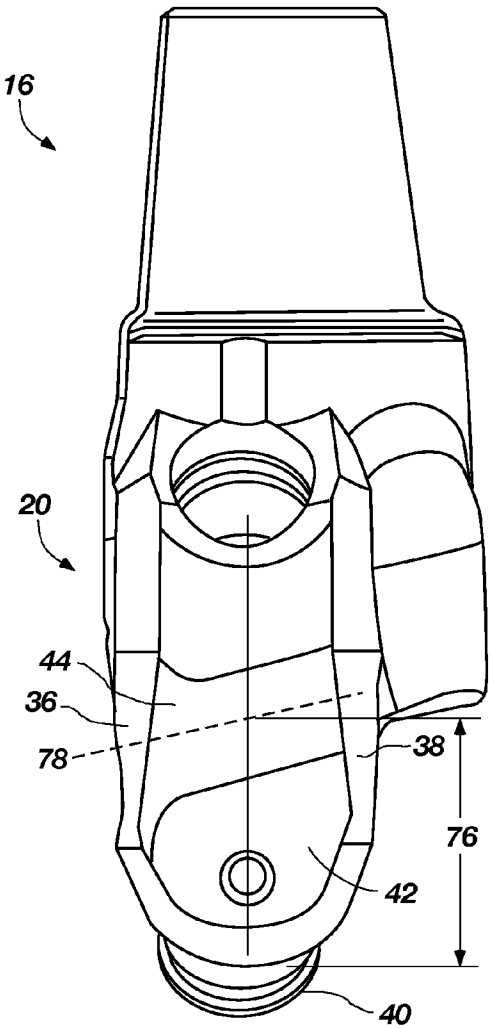
Figure 7A:
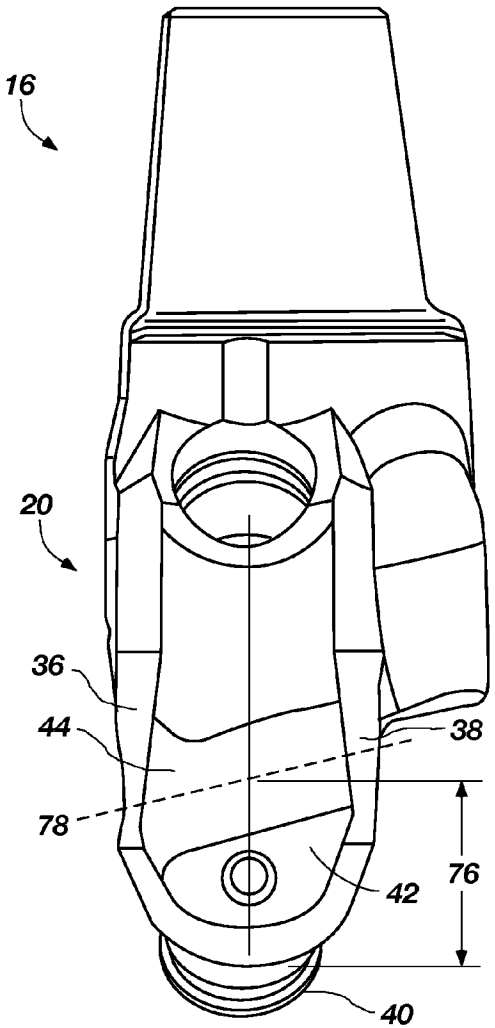

FIGS. 7A-7C illustrate an elevation view of individual head sections which may be assembled to comprise a bit body including three head sections similar to the bit body shown in FIG. 6. Each head section 16 may comprise at least one groove region 44 extending across the outer surface 42 of the head sections 16, each groove region 44 being positioned at a height 76 which differs from the height 76 on each of the other head sections 16. The groove region 44 on each head section 16 may extend generally helically across the outer surface 42. In some embodiments, the head sections 16 may be positioned so that a first head section may comprise a groove region 44 located generally in a lower portion of the bit leg 20, such as that illustrated in FIG. 7A. By way of example and not limitation, the groove region 44 in the first head section may be positioned generally in a lower one-third portion of the bit leg 20. The rotationally following or second head section 16 may be configured with a groove region 44 located generally central on the bit leg 20, such as illustrated in FIG. 7B. In some embodiments, the groove region 44 in the second head section 16 may be positioned at a height 76 such that at the rotationally leading side 36 of the bit leg 20, the groove region 44 of the second head section 16 may be generally aligned with the rotationally trailing side 38 of the groove region 44 of the first head section 16. Similarly, a third head section 16 rotationally following the second head section 16 may include a groove region 44 located generally in an upper portion of the bit leg 20, such as illustrated in FIG. 7C. By way of example and not limitation, the groove region 44 in the third head section 16 may be positioned generally in an upper one-third portion of the bit leg 20. In some embodiments, this groove region 44 in the third head section 16 may be positioned at a height 76 such that at the rotationally leading side 36 of the bit leg 20, the groove region 44 of the third head section 16 may be generally aligned with the rotationally trailing side 38 of the groove region 44 of the second head section 16.

In embodiments employing the pattern described above with relation to FIGS. 7A-7C, the combination of groove regions 44 on each of the circumferentially spaced head sections 16 may form a generally helical path for cuttings to flow around the outer circumference of the bit body 12 (FIGS. 1 and 6). Such a configuration may direct the cuttings upward (as the bit is positioned during drilling) and out from the bore hole as the earth-boring bit 10 is rotated in the bore hole. The flow of cuttings upward and outward from the bore hole may reduce the thickness of the cuttings bed, or may substantially eliminate such a cuttings bed.

Although the embodiments described with reference to FIGS. 6-7C describe the groove regions 44 having a sequential increase in height 76 from bit leg 20 to bit leg 20, it should be understood that the invention is not so limited. Indeed, in some embodiments comprising at least one groove region 44 on a plurality of bit legs 20, one bit leg 20 of the plurality of bit legs 20 may have at least one groove region 44 at a height 76 which is any one of higher, lower or equal to the height 76 of the at least one groove region 44 on the rotationally preceding bit leg 20 of the plurality of bit legs 20.

While the present invention has been described herein in relation to embodiments of earth-boring drill bits that include roller cones, other types of earth-boring tools including those employing roller cones or fixed cutters (such as polycrystalline diamond compact (PDC) cutters) or a combination thereof in the form of a so-called "hybrid" tool in the form of, for example, core bits, eccentric bits, bicenter bits, reamers, mills, and other such structures employing a rotational movement to remove formation material as known in the art may embody teachings of the present invention and may be formed by methods that embody teachings of the present invention, and, as used herein, the term "body" encompasses bodies of earth-boring roller cone bits, as well as bodies of other earth-boring tools including, but not limited to, core bits, eccentric bits, bicenter bits, reamers, mills, rotary drill bits, as well as other drilling and downhole tools. By way of example and not limitation, embodiments of the present invention may be provided on gage pads of fixed-cutter, PDC rotary drill bits.

Furthermore, while certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and equivalents, of the claims which follow.

What is claimed is:

1. An earth-boring bit comprising:

a bit body comprising a plurality of legs extending longitudinally therefrom;

a cutter rotatably mounted to a bearing shaft depending from each leg;

at least one groove in an outer surface of at least one leg, the at least one groove extending in a generally oblique direction across a radially outer surface of the at least one leg from a rotationally leading side of the at least one leg to a rotationally trailing side of the at least one leg;

a first region of hardfacing disposed over the at least one groove;

a second region of hardfacing disposed over an upper region of the radially outer surface of the at least one leg adjacent the at least one groove, the second region of hardfacing having an average thickness greater than an average thickness of the first region of hardfacing; and a third region of hardfacing disposed over a lower region of the radially outer surface of the at least one leg adjacent to the at least one groove, the third region of hardfacing having an average thickness greater than the average thickness of the first region of hardfacing.

2. The earth-boring bit of claim 1, wherein the at least one groove extends in a first general direction oriented at a first acute angle relative to a longitudinal axis of the bit body on the rotationally leading side of the radially outer surface of the at least one leg and extends in a second general direction oriented at a second acute angle relative to the longitudinal axis of the bit body on the rotationally trailing side of the radially outer surface of the at least one leg, the second acute angle being greater than the first acute angle.

3. The earth-boring bit of claim 2, further comprising a ridge extending adjacent to and below the at least one groove.

4. The earth-boring bit of claim 1, further comprising a fourth region of hardfacing disposed over a ridge region of the outer surface of the at least one leg, the fourth region of hardfacing having an average thickness greater than the average thickness of the second region of hardfacing and the average thickness of the third region of hardfacing.

5. The earth-boring bit of claim 1, wherein the first region of hardfacing, the second region of hardfacing, and the third region of hardfacing comprise substantially the same material composition.

6. The earth-boring bit of claim 1, further comprising hardfacing disposed along at least a portion of the rotationally leading side of the at least one leg.

7. The earth-boring bit of claim 1, wherein at least one groove is in at least one leg of the plurality of legs.

8. The earth-boring bit of claim 7, wherein at least one groove in at least one leg of the plurality of legs is located at a first height along a longitudinal axis of the bit body and at least another groove in at least another leg of the plurality of legs is located at a second height along the longitudinal axis of the bit body, the first height differing from the second height.

9. The earth-boring bit of claim 8, wherein the bit body comprises three legs and grooves of the at least one groove on each of the three legs are located in at least one of a lower one-third portion of each leg, a central portion of each leg, and an upper one-third portion of each leg.

10. An earth-boring bit, comprising:

a bit body comprising a plurality of head sections joined about a longitudinal axis of the bit body, each head section of the plurality of head sections comprising a bit leg, a cutter bearing shaft depending from the bit leg, and a cutter rotatably mounted to the cutter bearing shaft, the bit leg of at least one head section of the plurality of head sections comprising:

a first region of hardfacing material covering a groove region of an exterior surface of the bit leg, the first region of hardfacing material having an exterior surface disposed at a first average distance from the longitudinal axis of the bit body;

a second region of hardfacing material covering an upper region of an outer surface of the bit leg, the second region of hardfacing material having an exterior surface disposed at a second average distance from the longitudinal axis of the bit body, the second average distance being greater than the first average distance; and a third region of hardfacing material covering a lower shirttail region of the outer surface of the bit leg, the third region of hardfacing material having an exterior surface disposed at a third average distance from the longitudinal axis of the bit body, the third average distance being greater than the first average distance;

wherein the second region of hardfacing material at least partially defines at least one groove extending from a leading side of the bit leg to a trailing side of the bit leg along a generally helical path across the outer surface of the bit leg.

11. The earth-boring bit of claim 10, further comprising a fourth region of hardfacing material covering a ridge region of the outer surface of the bit leg, the fourth region of hardfacing material having an exterior surface disposed at a fourth average distance from the longitudinal axis of the bit body, the fourth average distance being greater than the second average distance and the third average distance, the fourth region of hardfacing material extending adjacent to and below the first region of hardfacing.

12. The earth-boring bit of claim 11, wherein the fourth region of hardfacing at least partially defines at least one ridge.

13. An earth-boring bit, comprising:

a bit body comprising a plurality of sections joined together about a longitudinal axis, each section comprising:

a head portion;

a bit leg depending from the head portion;

a cutter rotatably mounted to a cutter bearing shaft depending from the bit leg; and a groove extending across a laterally outer surface of the bit leg from a rotationally leading side thereof toward a rotationally trailing side thereof along a curved path;

wherein at least one groove in at least one bit leg is positioned at a first height along the longitudinal axis of the bit body and at least another groove in at least another bit leg is positioned at a second height along the longitudinal axis of the bit body, the first height being different from the second height.

14. The earth-boring bit of claim 13, wherein the groove is covered by a hardfacing material.

15. The earth-boring bit of claim 13, wherein the bit leg further comprises a ridge extending adjacent to and below the groove.

16. The earth-boring bit of claim 15, wherein the ridge extends across the outer surface of each bit leg from the rotationally leading side thereof toward the rotationally trailing side thereof.

17. The earth-boring bit of claim 13, wherein the at least one groove is located in a lower portion of the at least one bit leg, and the at least another groove is located at a higher position along the longitudinal axis of the bit body than the at least one groove, the at least one groove rotationally preceding the at least another groove.

18. An earth-boring bit, comprising:

a bit body comprising a plurality of legs extending longitudinally therefrom;

a plurality of cutters, each cutter rotatably mounted to a bearing shaft depending from each leg; and a plurality of grooves, each groove extending across a laterally outer surface of a bit leg from a rotationally leading side thereof toward a rotationally trailing side thereof; at least one groove in at least one bit leg located at a first height along a longitudinal axis of the bit body and at least another groove in at least another bit leg located at a second height along the longitudinal axis of the bit body, the first height being different from the second height.

19. The earth-boring bit of claim 18, wherein the at least one groove in the at least one bit leg is positioned in a lower portion of the at least one bit leg and each rotationally following groove is configured to be positioned higher than each rotationally following groove.

20. The earth-boring bit of claim 18, wherein each groove is covered by a hardfacing material.

21. The earth-boring bit of claim 18, wherein each bit leg further comprises a ridge extending adjacent to and below each groove.

22. The earth-boring bit of claim 21, wherein the ridge extends across the outer surface of each bit leg from the rotationally leading side thereof toward the rotationally trailing side thereof.

* * * * *